United States Patent [19]

Stuber et al.

[11] Patent Number: 4,843,829

[45] Date of Patent: Jul. 4, 1989

[54] RELIQUEFACTION OF BOIL-OFF FROM LIQUEFIED NATURAL GAS

[75] Inventors: Wayne G. Stuber, Whitehall; Kenneth W. Kovak, Macungie, both of Pa.

[73] Assignee: Air Products and Chemicals, Inc., Allentown, Pa.

[21] Appl. No.: 266,729

[22] Filed: Nov. 3, 1988

[51] Int. Cl.[4] ..... F17C 13/00

[52] U.S. Cl. ..... 62/54.2; 62/51.1

[58] Field of Search ..... 62/54, 514 R

[56] References Cited

U.S. PATENT DOCUMENTS

| | | | |
|---|---|---|---|
| 3,874,185 | 4/1975 | Etzbach | 62/40 |
| 3,889,485 | 6/1975 | Swearingen | 62/54 |
| 3,967,938 | 7/1976 | Daeschler et al. | 62/54 |
| 3,970,441 | 7/1976 | Etzbach et al. | 62/54 |
| 4,055,961 | 11/1977 | Admiral | 62/54 |
| 4,267,701 | 5/1981 | Toscano | 62/514 R |
| 4,437,312 | 3/1984 | Newton et al. | 62/514 R |
| 4,766,741 | 8/1988 | Bartlett et al. | 62/54 |

*Primary Examiner*—Ronald C. Capossela

*Attorney, Agent, or Firm*—Russell L. Brewer; James C. Simmons; William F. Marsh

[57] ABSTRACT

The present invention relates to an improved process for the reliquefaction of boil-off gas containing up to 10% nitrogen resulting from the evaporation of liquefied natural gas (LNG) contained in a storage vessel. In the process, a closed-loop nitrogen refrigeration cycle is utilized wherein the nitrogen is isenthalpically expanded under conditions for generating a liquid and vapor with the liquid being pressurized by pumping and warmed against an initially cooled boil-off stream. The boil-off LNG stream is initially cooled by indirect heat exchange with an isentropically expanded refrigerant stream.

7 Claims, 3 Drawing Sheets

RELIQUEFACTION OF BOIL-OFF FROM LIQUEFIED NATURAL GAS

TECHNICAL FIELD

The present invention relates to a process for recovering liquefied natural gas (LNG) boil-off from a storage vessel.

BACKGROUND OF THE INVENTION

In ocean tankers carrying cargoes of liquid natural gas (LNG), as well as land based storage tanks, a portion of the liquid, normally amounting to approximately 0.1 to 0.25% per day in the case of LNG, is lost through evaporation as a result of heat leak through the insulation surrounding the LNG storage receptacle. Moreover, heat leakage into LNG storage containers on both land and sea causes some of the liquid phase to vaporize thereby increasing the container pressure.

Shipboard LNG storage tank boil-off has typically been used as an auxiliary fuel source to power the ship's boilers and generators. However, recent LNG tanker designs have incorporated the use of diesel engines rather than steam driven engines thereby eliminating the need for supplemental energy supplied by LNG boil-off.

Recently enacted legislation prohibiting tanker disposal of hydrocarbon-containing streams by venting or flaring within the vicinity of metropolitan areas coupled with an increased desire to conserve energy costs have led to incorporation of reliquefiers into the design of new tankers for recovering LNG boil-off.

Attempts have been made to recover nitrogen-containing natural gas boil-off vaporized from a storage tank. Typically, these systems employ a closed-loop refrigeration system wherein cycle gas is compressed, cooled and expanded to produce refrigeration prior to return to the compressor. The following patent is representative:

U.S. Pat. No. 3,874,185 discloses a reliquefaction process utilizing a closed-loop nitrogen refrigeration cycle wherein the lowest level or coldest level or refrigeration for condensation of LNG is provided by an isentropically expanded stream while the remaining refrigeration is provided by isenthalpic expansion of the residual second fraction of refrigerant. In one embodiment, the residual fraction of the isenthalpically expanded stream is subjected to a phase separation wherein liquid and vapor fractions are separated. During periods of low refrigeration requirements a portion of the liquid fraction is stored, and, during periods of higher refrigeration requirements, a portion of the stored liquid fraction is recycled into the refrigeration system.

SUMMARY OF THE INVENTION

The present invention provides a flexible and highly efficient process for reliquefaction of boil-off gas containing from 0 to about 10% nitrogen. Prior art processes are typically unable to efficiently reliquefy boil-off where the nitrogen content varies over such a wide range. They are designed to operate optimally within a narrow concentration range. As the concentration of contaminants moves away from design criteria, the reliquefiers become less efficient. Embodiments of the present invention eliminate this deficiency.

The present invention is an improvement in a process for reliquefying LNG boil-off resulitng from the evapaoration of liquefied natural gas within a storage receptacle utilizing a closed-loop nitrogen refrigeration cycle. In the process for reliquefying boil-off gas, the closed-loop refrigeration system comprises the steps:

compressing nitrogen as a working fluid in a multi-stage compressor system having an initial and final stage to form a compressed working fluid;

splitting the compressed working fluid into a first and second stream;

isenthalpically expanding the first stream to produce a cooled first stream and then warming against boil-off gas and warming against recycle compressed working fluid;

isentropically expanding the second stream to form a cooled expanded stream and then warming against boil-off gas and warming against the working fluid; and finally returning the resulting warmed isenthalpically expanded and isentropically expanded streams to the multi-stage compressor system.

The improvement for reliquefying LNG boil-off gas containing from about 0 to 10% nitrogen by volume in a closed loop refrigeration process comprises:

(a) effecting isenthalpic expansion of said first stream under conditions such that at least a liquid fraction is generated.

(b) separating the vapor fraction, if generated, from the liquid fraction;

(c) warming the vapor fraction against boil-off gas and recycle compressed working fluid;

(d) pressuring at least a portion of the liquid fraction formed in step (a) e.g. to a pressure intermediate the initial and final stage of the multi-stage compressor system;

(e) warming the resultant pressurized liquid fraction first against boil-off gas and then in parallel with the warming of said isentropically expanded second stream; and (f) returning the resultant warmed pressurized liquid fraction to a stage of the multi-stage compressor system.

Several advantages are achieved by the present invention. They are:

(a) an ability to obtain a closer match between the warming curve of the refrigerant cycle gases and the cooling curve of the LNG boil-off stream thereby reducing energy requirements to achieve liquefaction; and (b) an ability to obtain greater efficiency permitting reduction of the heat exchanger surface area required to achieve liquefaction.

DETAILED DESCRIPTION OF THE INVENTION

The improvement in this process for reliquefying boil-off gases resulting from the vaporization of liquefied natural gas contained in a storage vessel is achieved through the modification of a closed-loop refrigeration system. Conventionally, the closed loop refrigeration systems use nitrogen as a refrigerant or working fluid, and in the conventional process, the nitrogen is compressed through a series of multi-stage compressors, having initial and final stage, and usually in combination with aftercoolers, to a preselected pressure. This compressed nitrogen stream is split with one fraction being isenthalpically expanded an the other being isentropically expanded. Typically, the work from the isentropic expansion is used to drive the final stage of compression. Refrigeration is achieved through such isenthalpic and isentropic expansion and that refrigeration is used to reliquefy the boil-off gas. The objective is to match the cooling curves with the warming curves and avoid significant separations between such curves. Separations are evidence of lost refrigeration value.

Figure 1:
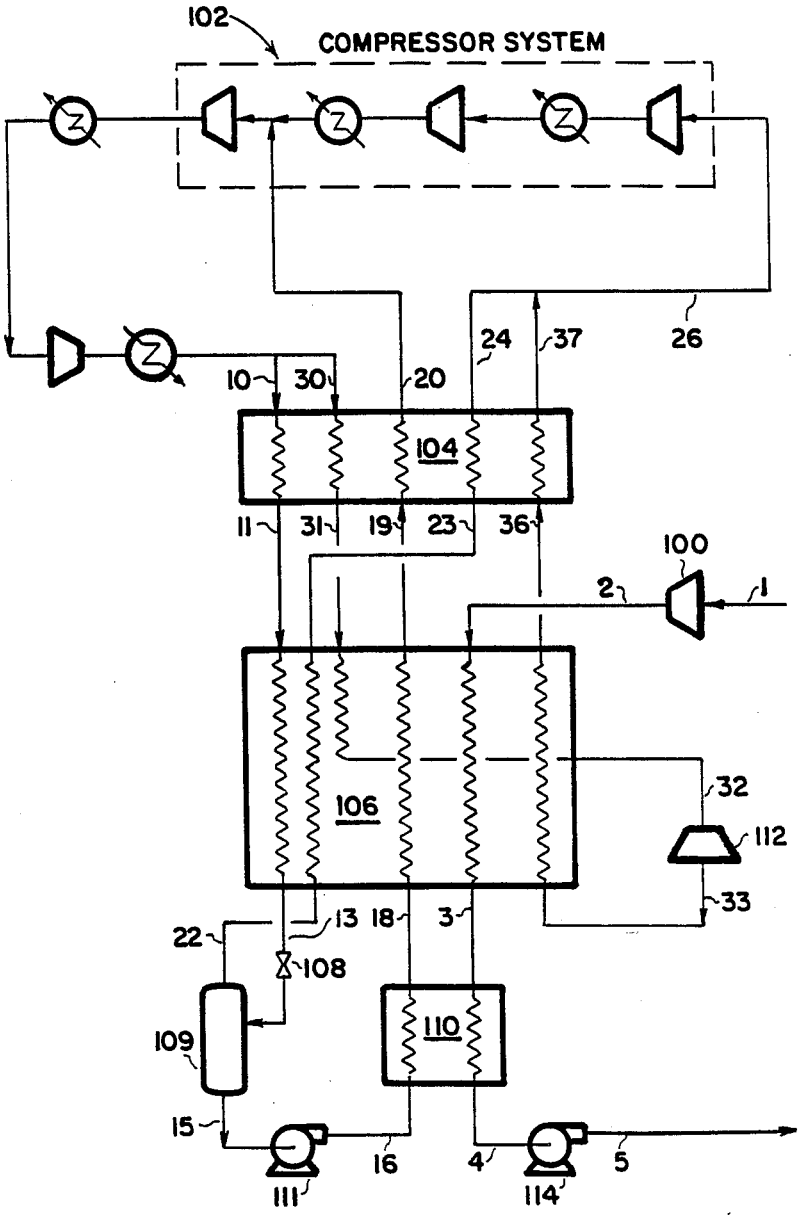
FIG. 1 is a process flow diagram illustrating the closed loop process referred to as the Pumped JT process.

To facilitate an understanding of the invention, reference is made to FIG. 1. In accordance with the embodiment referred to as the Pumped JT process as shown in FIG. 1, natural gas (methane) to be reliquefied is withdrawn from a storage tank (not shown) via conduit 1 and compressed in a boil-off compressor 100 to a pressure sufficient for processing during reliquefaction.

Refrigeration requirements for reliquefying the LNG boil-off are provided through a closed-loop refrigeration system using nitrogen as the working fluid or cycle gas. In this refrigeration system, nitrogen is compressed from ambient pressure through a series of multi-stage compressors having aftercoolers 102 to a sufficient pressure, e.g., 500–1000 psia. Thermodynamic efficiency is enhanced by using large pressure differences in the nitrogen cycle.

In the reliquefaction process, a first stream 10 is cooled in heat exchanger 104 and then via line 11 in heat exchange 106. The cooled first stream at a temperature from about −185° F. to −85° F. is withdrawn through line 13 and expanded in JT valve 108 under conditions sufficient to generate a liquid e.g., to a pressure from about 25 to 125 psia. Separator 109 is provided after the isenthalpic expansion to permit storage of liquid for subsequent use in the event of flowrate or composition change and to permit the separation of vapor, if generated by the expansion, from the liquid. Any vapor fraction is withdrawn from separator 109 and removed via line 22 and warmed against boil-off gas and against the first stream prior to its isenthalpic expansion via lines 23 and 24 prior to return to multi-stage compressor system 102. The liquid is removed from separator 109 via line 15 and the liquid is pressurized in pump 111 to a pressure from about 150 to 250 psia. From there it is conducted via line 16 through heat exchanger 110. In heat exchanger 110, the boil-off gas is condensed and cooled to its lowest temperature level e.g., −290° F. to −300° F. against the pressurized liquid refrigerant. The pressurized liquid is then conveyed via lines 18, 19 and 20, and warmed to a vapor state through heat exchangers 106 and 104, to a stage usually intermediate to the initial and final stage of the multi-stage compressor system 102. The use of pressure permits a closer match of the cooling and warming curves, particularly at the higher nitrogen levels than achieved with other processes, and the return of a recycle stream at the higher pressure.

The remaining refrigeration is supplied by the isentropic expansion of second stream 30. Second stream 30 is cooled in heat exchange 104 and then via line 31 in heat exchanger 106 to a temperature from about −75° to −150° F. and then conveyed via line 32 to expander 112. It is then isentropically expanded to a pressure of about 25 to 125 psia which is usually at the same pressure as that of the isenthalpic expansion of the first stream, although it may be intermediate to that of the isenthalpically expanded stream and pumped stream. The isentropically expanded stream is conveyed via line 33 to heat exchanger 106 then via line 36 through heat exchangers 104 and then via line 37 to compressor system 102. Thus, the coldest level of refrigeration for the boil-off is supplied through the isenthalpic expansion of the working fluid in contrast to systems which have used isentropically expanded working fluids as the coldest level of refrigeration.

Liquefaction of boil-off is achieved in the following manner: The boil-off gas is removed from the storage vessel via line 1 and compressed in boil-off gas compressor 100 and then passed via lines 2, 3 and 4 through heat exchangers 106 and 110 for liquefaction. On exiting heat exchanger 110, the liquefied LNG is removed via line 4 and pressurized in pump 114 where it is transferred via line 5 to the storage vessel.

The following examples are provided to illustrate various embodiments of the invention and are not intended to restrict the scope thereof.

EXAMPLE 1

Pumped JT Process

A recovery system for LNG boil-off was carried out in accordance with the process scheme as set forth in FIG. 1. Nitrogen concentrations varied from 0% to about 10% by volume of the boil-off gas. Table 1 provides stream properties and rates in lb moles/hr corresponding to the numbers designated in FIG. 1 for a boil-off gas containing 0% LNG.

Table 2 provides field properties corresponding to numbers designated in FIG. 1 or for a boil-off gas containing approximately 10% nitrogen by volume.

Table 3 provides stream properties corresponding to a prior art process scheme described in U.S. Pat. No. 3,874,185 where the nitrogen concentration in the boil-off gas is 0%.

Table 4 provides stream properties for liquefaction of a prior art process scheme described in U.S. Pat. No. 3,874,185 for a boil-off gas containing 10% nitrogen.

TABLE 1

FIG. 1 - Pumped JT - 0% $N_2$

| Stream No. | $N_2$ lb Moles/hr | $CH_4$ Moles/hr | T °F. | Press. Psia | Phase |
|---|---|---|---|---|---|
| 1 | — | 292 | −138 | 14.9 | VAP |
| 2 | — | 292 | −98 | 20 | VAP |
| 3 | — | 292 | −254 | 18 | VAP |
| 4 | — | 292 | −275 | 17 | LIQ |
| 5 | — | 292 | −275 | 35 | LIQ |
| 10 | 762 | — | 95 | 800 | VAP |
| 11 | 762 | — | −98 | 796 | VAP |
| 13 | 762 | — | −254 | 788 | VAP |
| 14 | 762 | — | −248 | 315 | LIQ |
| 15 | 581 | — | −283 | 96 | LIQ |
| 16 | 581 | — | −279 | 240 | LIQ |
| 18 | 581 | — | −258 | 238 | VAP |
| 19 | 581 | — | −128 | 234 | VAP |
| 20 | 581 | — | 89 | 232 | VAP |
| 22 | 180 | — | −283 | 96 | VAP |
| 23 | 180 | — | −128 | 92 | VAP |
| 24 | 180 | — | 89 | 90 | VAP |
| 30 | 1720 | — | 95 | 800 | VAP |
| 31 | 1720 | — | −98 | 796 | VAP |
| 32 | 1720 | — | −112 | 794 | VAP |
| 33 | 1720 | — | −261 | 96 | VAP |
| 36 | 1720 | — | −128 | 92 | VAP |
| 37 | 1720 | — | 89 | 90 | VAP |
| 38 | 1901 | — | 89 | 90 | VAP |

TABLE 2

| FIG. 1 - PUMPED JT - 10% $N_2$ | | | | | |
|---|---|---|---|---|---|
| Stream No. | $N_2$ lb Moles/hr | $CH_4$ Moles/hr | T °F. | Press. Psia | Phase |
| 1 | 32 | 289 | −202 | 15.5 | VAP |
| 2 | 32 | 289 | −175 | 20 | VAP |
| 3 | 32 | 289 | −256 | 18 | VAP |
| 4 | 32 | 289 | −296 | 16 | LIQ |
| 10 | 739 | — | 99 | 800 | VAP |
| 11 | 739 | — | −122 | 796 | VAP |
| 13 | 739 | — | −246 | 788 | LIQ |
| 14 | 739 | — | −300 | 45 | VAP |
| 15 | 492 | — | −304 | 36 | LIQ |
| 16 | 492 | — | −301 | 164 | LIQ |
| 17 | 492 | — | −260 | 162 | VAP |
| 18 | 739 | — | −304 | 43 | VAP |
| 19 | 492 | — | 94 | 156 | VAP |
| 20 | 492 | — | 98 | 156 | VAP |
| 26 | 1736 | — | 94 | 88 | VAP |
| 30 | 1736 | — | 99 | 800 | VAP |
| 32 | 1736 | — | −122 | 792 | VAP |
| 33 | 1736 | — | −267 | 96 | VAP |
| 36 | 1736 | — | −159 | 92 | VAP |
| 37 | 1736 | — | 95 | 90 | VAP |

TABLE 3

Figure 2:
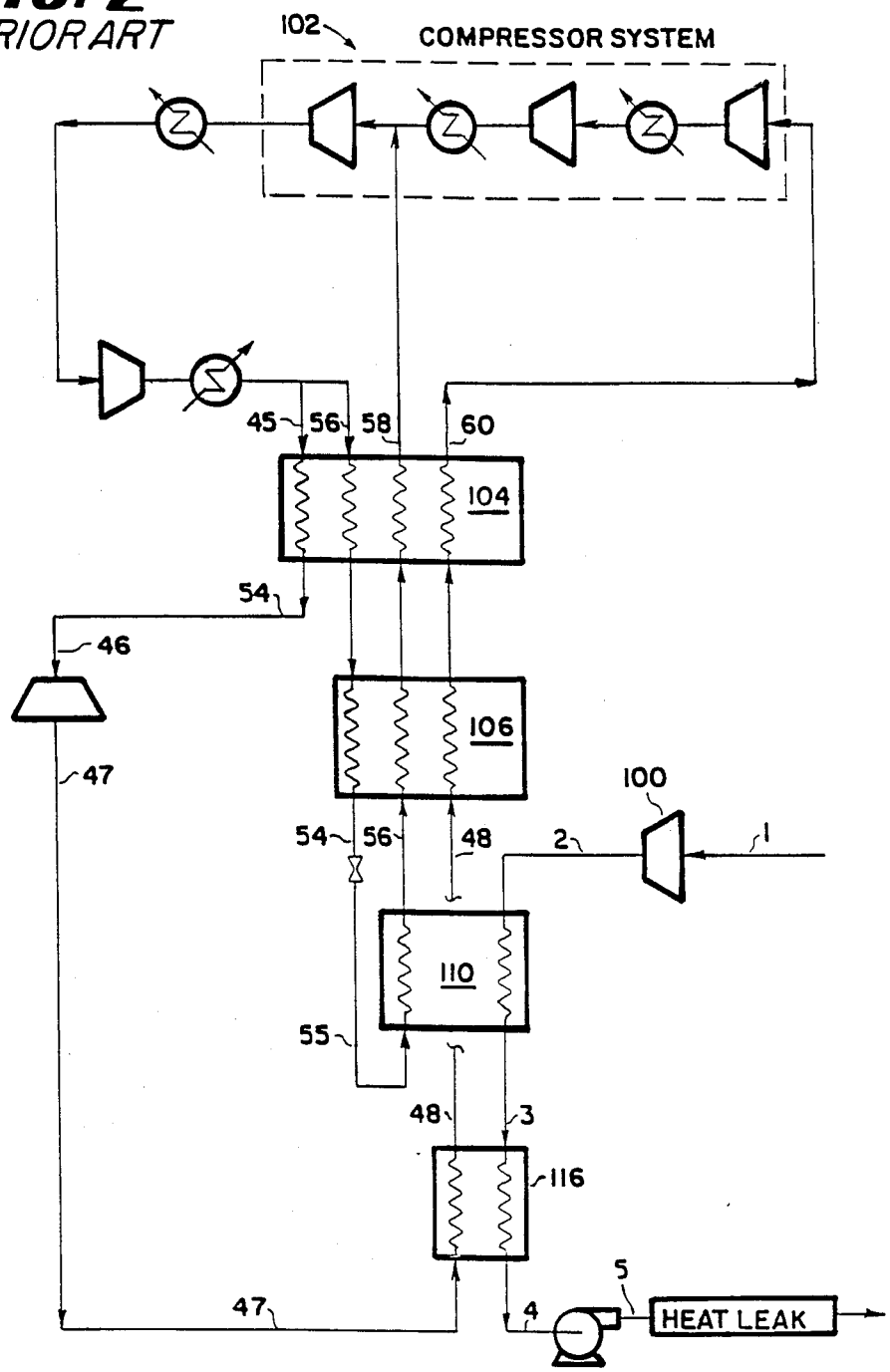
FIG. 2 PRIOR ART
FIG. 2 is a process flow diagram of a prior art closed loop process for recovering boil-off gas.
Figure 3:
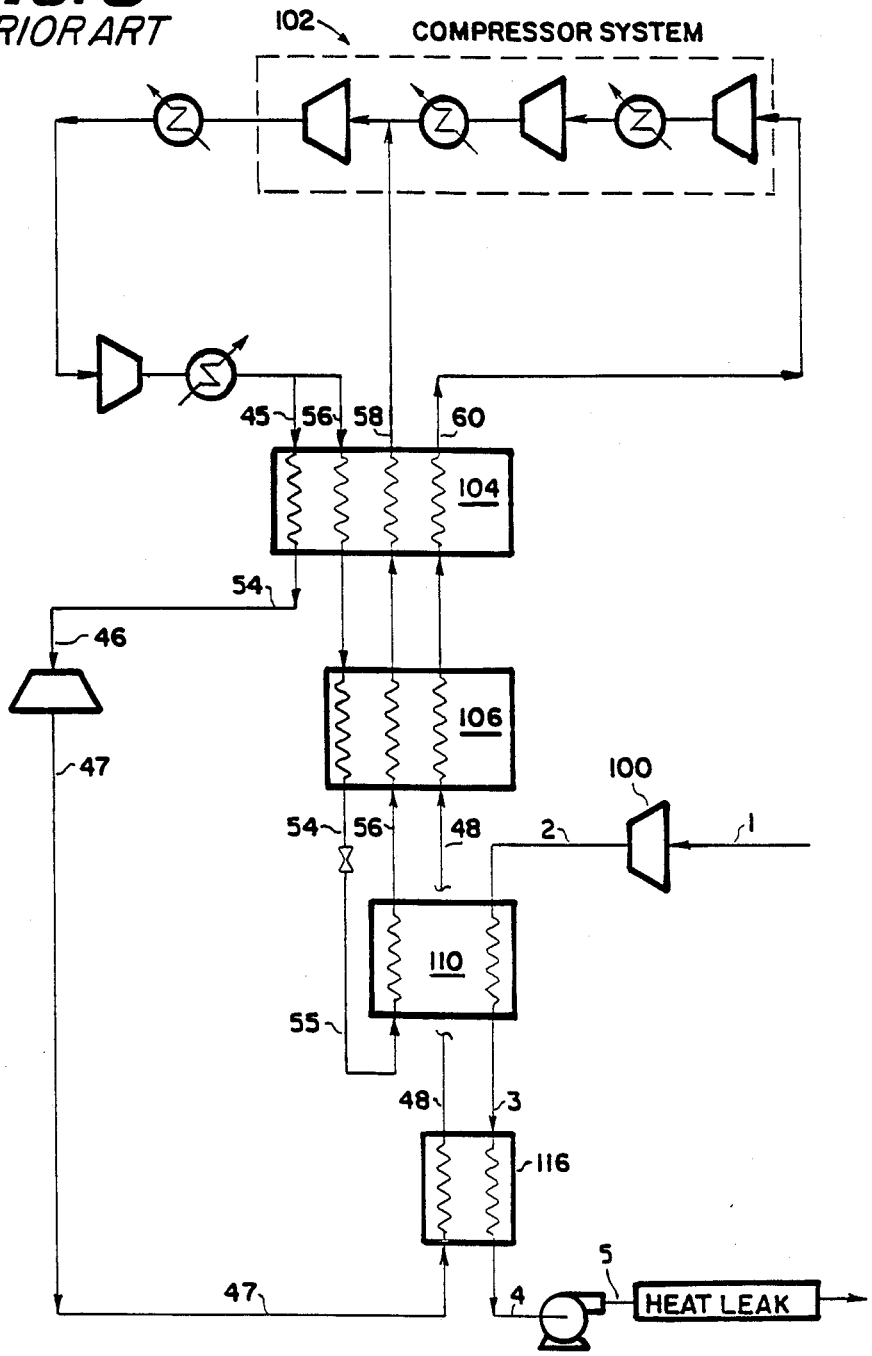
FIG. 3 PRIOR ART

| PRIOR ART - FIG. 2 - U.S. Pat. No. 3,874,185 - 0% $N_2$ | | | | | |
|---|---|---|---|---|---|
| Stream No. | $N_2$ lb Moles/hr | $CH_4$ Moles/hr | T °F. | Press. Psia | Phase or Dew Point °C. |
| 1 | — | 292 | −138 | 14.9 | VAP |
| 2 | — | 292 | −38 | 30 | VAP |
| 3 | — | 292 | −243 | 28 | V + L |
| 4 | — | 292 | −276 | 27 | LIQ |
| 45 | 2368 | — | 95 | 653 | VAP |
| 46 | 2368 | — | −150 | 647 | VAP |
| 47 | 2368 | — | −278 | 91.1 | VAP |
| 48 | 2368 | — | −245 | 88.1 | VAP |
| 60 | 2368 | — | 90 | 85 | VAP |
| 52 | 415 | — | 95 | 653 | VAP |
| 54 | 415 | — | −243 | 641 | LIQ |
| 55 | 415 | — | −247 | 348 | LIQ |
| 56 | 415 | — | −126 | 343 | VAP |
| 58 | 415 | — | 90 | 337 | VAP |

TABLE 4

| PRIOR ART - FIG. 2 - U.S. Pat. No. 3,874,185 - 10% $N_2$ | | | | | |
|---|---|---|---|---|---|
| Stream No. | $N_2$ lb Moles/hr | $CH_4$ Moles/hr | T °F. | Press. Psia | Phase |
| 1 | 32 | 289 | −202 | 15.5 | VAP |
| 2 | 32 | 289 | −125 | 30 | VAP |
| 3 | 32 | 289 | −260 | 28 | V + L |
| 4 | 32 | 289 | −296 | 27 | LIQ |
| 5 | 32 | 289 | −295 | 60 | LIQ |
| 45 | 2056 | — | 99 | 653 | VAP |
| 46 | 2056 | — | −164 | 480 | VAP |
| 47 | 2056 | — | 298 | 48 | VAP |
| 48 | 2056 | — | −263 | 45 | VAP |
| 60 | 2056 | — | 94 | 42 | VAP |
| 52 | 391 | — | 99 | 653 | VAP |
| 54 | 391 | — | −260 | 641 | VAP |
| 55 | 391 | — | −263 | 202 | V + L |
| 56 | 391 | — | −150 | 197 | VAP |
| 58 | 391 | — | 94 | 191 | VAP |

Calculations were made determining the heat exchanger requirements expressed as U times A where U is the heat transfer coefficient and A is the area of heat exchanger surface for the processes set forth in Tables 1–4. Compressor power requirements are also given. These values are set forth in Table 5.

TABLE 5

| Process | Boil-off $N_2$ % | Heat Exchanger UA (BTU/Hr °F.) | Power HP |
|---|---|---|---|
| Table 1 | 0 | 792,244 | 2,724 |
| Table 2 | 10 | 713,445 | 3,050 |
| Table 3 | 0 | 797,110 | 2,801 |
| Table 4 | 10 | 702,094 | 3,550 |

From these results, it can be seen the Pumped JT system (Tables 1&2) is superior to the FIG. 2 prior art system at a 0% $N_2$ and 10% $N_2$ level in the feed.

What is claimed:

1. In a process for liquifying boil-off gas resulting from the evaporation of liquified natural gas contained in a storage vessel, the boil-off gas being cooled and liquified in a closed-loop nitrogen refrigeration system and then returned to said storage vessel wherein said closed-loop refrigeration system comprises the steps:

compressing nitrogen as a working fluid in a multi-stage compressor system having an initial and final stage to form a compressed working fluid;

splitting said compressed working fluid into a first and second stream;

isenthalpically expanding said first stream to produce a cooled first stream, then warming against recycle compressed working fluid and boil-off gas;

isentropically expanding the second stream to form a cooled expanded stream which is then warmed against boil-off gas and working fluid prior to return to the compressor system;

the improvement for reliquefying a boil-off gas containing from about 0 to 10% nitrogen by volume which comprises:

(a) effecting isenthalpic expansion of said first stream under conditions such that at least a liquid fraction is generated;

(b) separating any vapor fraction, if generated, from the liquid fraction;

(c) warming the vapor fraction, if generated, against boil-off gas and recycle compressed working fluid;

(d) pressurizing the liquid fraction formed in step (a) by pumping;

(e) warming the pressurized liquid fraction first against boil-off gas and then in parallel with the warming of said isentropically expanded second stream.

2. The process of claim 1 wherein the nitrogen working fluid is compressed to a pressure from about 500 to 1000 psia.

3. The process of claim 2 wherein the first stream is cooled to a temperature from about −185° to −85° F. prior to the isenthalpic expansion.

4. The process of claim 3 wherein the first stream is expanded to a pressure from 25 to 125 psia in the isenthalpic expansion.

5. The process of claim 4 wherein the second stream is cooled to a temperature of from about −75° to −150° F. prior to isentropic expansion.

6. The process of claim 5 wherein the second stream is expanded to a pressure from about 25 to 125 psia.

7. The process of claim 6 wherein the pressure of the liquid from isenthalpic expansion is increased to about 125 to 275 psia and is returned to a stage intermediate the initial and final stage of the multi-stage compressor system.

* * * * *